US009230457B2

(12) United States Patent
Lin

(10) Patent No.: US 9,230,457 B2
(45) Date of Patent: Jan. 5, 2016

(54) ADJUSTABLE LARGE-SIZED ADVERTISEMENT CURTAIN WIND-RESISTANT MODULE

(71) Applicant: Ruei-Hsing Lin, New Taipei (TW)

(72) Inventor: Ruei-Hsing Lin, New Taipei (TW)

( * ) Notice: Subject to any disclaimer, the term of this patent is extended or adjusted under 35 U.S.C. 154(b) by 225 days.

(21) Appl. No.: 14/093,531

(22) Filed: Dec. 2, 2013

(65) Prior Publication Data

US 2015/0154893 A1 Jun. 4, 2015

(51) Int. Cl.

| | |
|---|---|
| ***G09F 15/00*** | (2006.01) |
| ***G09F 21/00*** | (2006.01) |
| ***G09F 7/00*** | (2006.01) |
| ***E06B 9/58*** | (2006.01) |
| ***G09F 19/22*** | (2006.01) |
| *G09F 7/22* | (2006.01) |
| *G09F 21/04* | (2006.01) |

(52) U.S. Cl.

CPC . *G09F 7/002* (2013.01); *E06B 9/58* (2013.01); *G09F 15/0018* (2013.01); *G09F 19/226* (2013.01); *G09F 21/04* (2013.01); *G09F 7/22* (2013.01); *G09F 15/0006* (2013.01); *G09F 15/0025* (2013.01); *G09F 15/0087* (2013.01); *G09F 21/048* (2013.01); *G09F 2015/0093* (2013.01)

(58) Field of Classification Search

CPC ..... G09F 15/0006; G09F 15/0025; G09F 15/0087; G09F 7/22; G09F 21/04; G09F 21/048; G09F 19/226; G09F 7/002

USPC ..... 248/157, 419, 422, 429, 424, 287.1, 248/298.1, 257, 269, 273; 40/601, 602, 40/603; 160/338, 339, 84.06, 181, 194, 160/911, 913

See application file for complete search history.

(56) References Cited

U.S. PATENT DOCUMENTS

| | | | | |
|---|---|---|---|---|
| 2,839,135 A * | 6/1958 | Anderson | E06B 9/581 160/133 |
| 3,609,898 A * | 10/1971 | Brown | G09F 15/0087 40/601 |
| 5,477,902 A * | 12/1995 | Kraeutler | E06B 9/13 160/264 |
| 6,260,601 B1 * | 7/2001 | Thomas | E05D 15/165 160/133 |
| 7,121,029 B2 * | 10/2006 | Wilson | G09F 17/00 40/601 |
| 7,614,172 B2 * | 11/2009 | Kennedy | G09F 17/00 40/601 |

(Continued)

FOREIGN PATENT DOCUMENTS

| | | | |
|---|---|---|---|
| FR | 3014234 | * 12/2013 | G09F 7/22 |
| GB | 20933 | * 6/2015 | G09F 15/00 |

*Primary Examiner* — Tan Le

(74) *Attorney, Agent, or Firm* — Leong C. Lei

(57) ABSTRACT

The present invention relates to an adjustable large-sized advertisement curtain wind-resistant module, which includes a base, the slidable board, a coupler, a transmission device, and a transmission rod. The base has a screw rod. The slidable board has a surface slidably mounted to the base and coupled with the screw rod and an opposite surface to which the coupler is mounted for coupling with the frame. The transmission device is arranged in the base and coupled to the screw rod. The transmission rod drives the transmission device and the transmission device in turn drives the screw rod, so that the screw rod may drive the slidable board to do linear displacement on the base. The linear displacement of the slidable board in opposite directions carries the frame to be moved in unison therewith to achieve adjustment of distance between two frames for stretching flat an advertisement curtain between the frames.

7 Claims, 8 Drawing Sheets

(56) References Cited

U.S. PATENT DOCUMENTS 8,505,163 B2 * 8/2013 Lin ..... G09F 7/002 16/87.8

8,573,418 B2 * 11/2013 Lin ..... G09F 15/0012 40/601

8,763,290 B1 * 7/2014 Lin ..... G09F 15/0006 160/339

* cited by examiner

ADJUSTABLE LARGE-SIZED ADVERTISEMENT CURTAIN WIND-RESISTANT MODULE

TECHNICAL FIELD OF THE INVENTION

The present invention generally relates to an adjustable large-sized advertisement curtain wind-resistant module, and more particularly to one that is provided for supporting a frame of an advertisement curtain by adopting a slidable board that is allowed to do linear displacement on a base (such as in leftward or rightward directions for adjustment) so that with the frame of the advertisement curtain coupled by a coupler mounted to the slidable board, the linear displacement can make the frame undergoing adjustment in a synchronous manner and thus, the advertisement curtain mounted to the frame is provided with effective and efficient adjustment for being stretched flat thereby completely overcoming the problem of a medium- or large-sized advertisement curtain caused by over-sizing or under-sizing resulting from the size hugeness of the advertisement curtain. Further, the slidable board is provided with a cushioning device so that the cushioning device provides the slidable board with effects of elasticity and position returning and thus providing the frame with variability of the distance between two frames through elastic expansion/retraction, whereby when winds impact the advertisement curtains from either the front side or the back side to induce a stress in the advertisement curtain resulting from the wind drag (wind pressure), the frame is allowed for position returning due to the elasticity of the slidable board so as to provide an improved mechanism against wind drag (wind pressure) thereby ensuring an effect of cushioning and wind resisting and preventing tearing of the advertisement curtain and deformation and tipping of the frame due to excessive stress born by the advertisement curtain acted upon by the wind drag (wind pressure).

Further, for shaking or vibration of a high erected advertisement caused by earthquakes, the cushioning device arranged on the slidable board provides an effect of cushioning and releasing, so that the present invention provides an advantage of effectively eliminating stretching between the advertisement curtain and the frame resulting from such a situation and thus achieving cushioning and balancing against earthquakes.

DESCRIPTION OF THE PRIOR ART

Advertisement is a manner of promotion that achieves communication with a target group of people by attracting the attention of people through language, text, figures, or image carried with communication media.

The progress of industry and science and technology speeds up the diversification of communication media, and an increasing number of measures of advertisement are developed, such as billboards installed on the top of high building, advertisement attached to walls of high buildings, billboards standing on intersections, posters or commercial banners attached to transportation vehicles, standing by main roads/streets, or advertising boards constructed in exhibitions, which are numerous and diversified.

In respect of medium- or large-sized commercial advertisement curtains, besides of the prominent effects of being huge, shocking, and being a noticeable distant viewing target, they are surely excellent measures of advertisement, particularly for sports grounds, exhibitions, high building curtains, building tops, walls of stand-alone erected or huge constructions. They are one of the most favorable advertisement measures that large businesses will adopt and are also the focus of the eyesight of general consumers. In other words, such a medium- or large-sized advertisement curtain is now the best way of advertisement and is the most important business opportunity that the advertisement business are seeking for and pursuing. However, a conventional large-sized advertisement curtain is often composed of a frame that is made up of a plurality of frame members to show a desired configuration for advertisement. Each of the frame members comprises retention slots (or slits), so that cables extending through eyelets formed in edges of an advertisement sheet can be knotted and fixed to the retention slots (slits) of the frame members for stretching the advertisement sheet for showing a substantially planar form that is fixed to the entire frame.

For this type of medium- and large-sized advertisement curtain, installation operations are operations carried out in a high place, such as building top and a wall of a large building, so that stresses induced by wind drag (wind pressure) are definitely high. One of the events that are commonly encountered is that the advertisement sheet must be stretched by cables that are respectively knotted and fixed to the retention slots (slits) of the frame members in order to flatten, expand, and retain the entire advertisement sheet in position. Such an operation is obviously risky, labor consuming, and time consuming and particularly, once completed, the distance between frame members is fixed and cannot be altered. In case there is a mistake where the advertisement curtain is made over-sized or under-sized, the advertisement curtain cannot be fixed in a flat (planar) condition. If the curtain is over-sized, wrinkles and corrugations would occur on the surface of the advertisement curtain and there would be additional stresses caused excessive wind drag (wind pressure). If it is under-sized, then the curtain must be removed, re-manufactured, and re-installed, which are generally sophisticated and tedious processes requiring additional cost and risk.

It is also generally realized that the advertisement curtain is constantly subjected to impacts caused by wind drags (wind pressures) in different directions and the advertisement curtain would undergo vibration and shake caused by the wind drags. The instantaneous reaction forces resulting from the vibration and shake would be transmitted to the entire frame. However, the conventional advertisement curtains and frames are generally not provided with a wind drag cushioning mechanism. Thus, the frame, when exposed a destructive wind drags, would be bent, deformed, or collapsed, eventually damaging and breaking the frame structure of the medium- or large-sized advertisement curtain. This causes difficult for subsequent maintenance and repair, which, besides being a risky operation, would take a great expense for conducting the operation of maintenance.

Thus, to handle the wind drags (wind pressures) acting on a medium- or large-sized advertisement curtain, a common solution generally taken is to form a plurality of openings in the curtain, allowing wind drags (wind pressures) to be released through the openings so as to reduce the wind drags (wind pressures) acting on the curtain. However, the openings causes insufficiency of integrity and aesthetics of the advertisement and lead to poor effect of advertisement.

SUMMARY OF THE INVENTION

The primary object of the present invention discloses an adjustable large-sized advertisement curtain wind-resistant module, which supports a frame of an advertisement curtain in a movable manner to adjust the distance between two frames and to cushion and release the wind drag (wind pressure) acting on the advertisement curtain, particularly destructive stress induced by such wind drag (wind pressure), and comprises: a base, a slidable board, a couplet; a transmission device, and a transmission rod, wherein the base comprises first slide rails and a screw rod; the slidable board has a surface on which second slide rails are formed in such a way that the second slide rails are engageable with the first slide rails of the base and are slidable with respect thereto so that the slidable board is movable linearly on the base and an opposite surface to which the coupler is mounted so that the coupler functions to couple the frame; and the transmission device is arranged in the base and coupled to the screw rod; the transmission rod is coupled to the transmission device, so that the transmission rod drives the transmission device, the transmission device drives the screw rod, and then the screw rod drives the slidable board to linearly slide on the base in opposite directions. When the size of an advertisement curtain is different from the distance between two frames, the slidable board is adjusted to move linearly in either directions so as to carry the frame to move in unison therewith thereby adjusting the distance between the two frames to achieve the optimum adjustment of the advertisement curtain, particularly for minute adjustment to be done after the installation of the advertisement curtain.

The secondary object of the present invention is to disclose an adjustable large-sized advertisement curtain wind-resistant module, wherein the slidable board comprises a cushioning device, whereby the cushioning device provides an effect of elasticity-based position returning to the slidable board to thereby realize adjustment of the distance between the two frames through elastic expandability/retractability, so that for impacts of wind acting on the advertisement curtain in any direction and the advertisement curtain bearing the wind drags (wind pressure), protection of the frame can be ensured in such a way that the frame can be supported by the elasticity based position returning effect of the slidable board to resist and release the wind drag. This can provide various effect of cushioning depending upon the strength of the wind force acting thereon.

Further, the cushioning device provided on the slidable board allows the present invention to resist, with the elastic nature of the cushioning device, stretching between the advertisement curtain and the frame caused by irregular shaking or vibration of the advertisement resulting from for example earthquake so as to achieve an advantage of self-cushioning and improved balancing in earthquakes.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
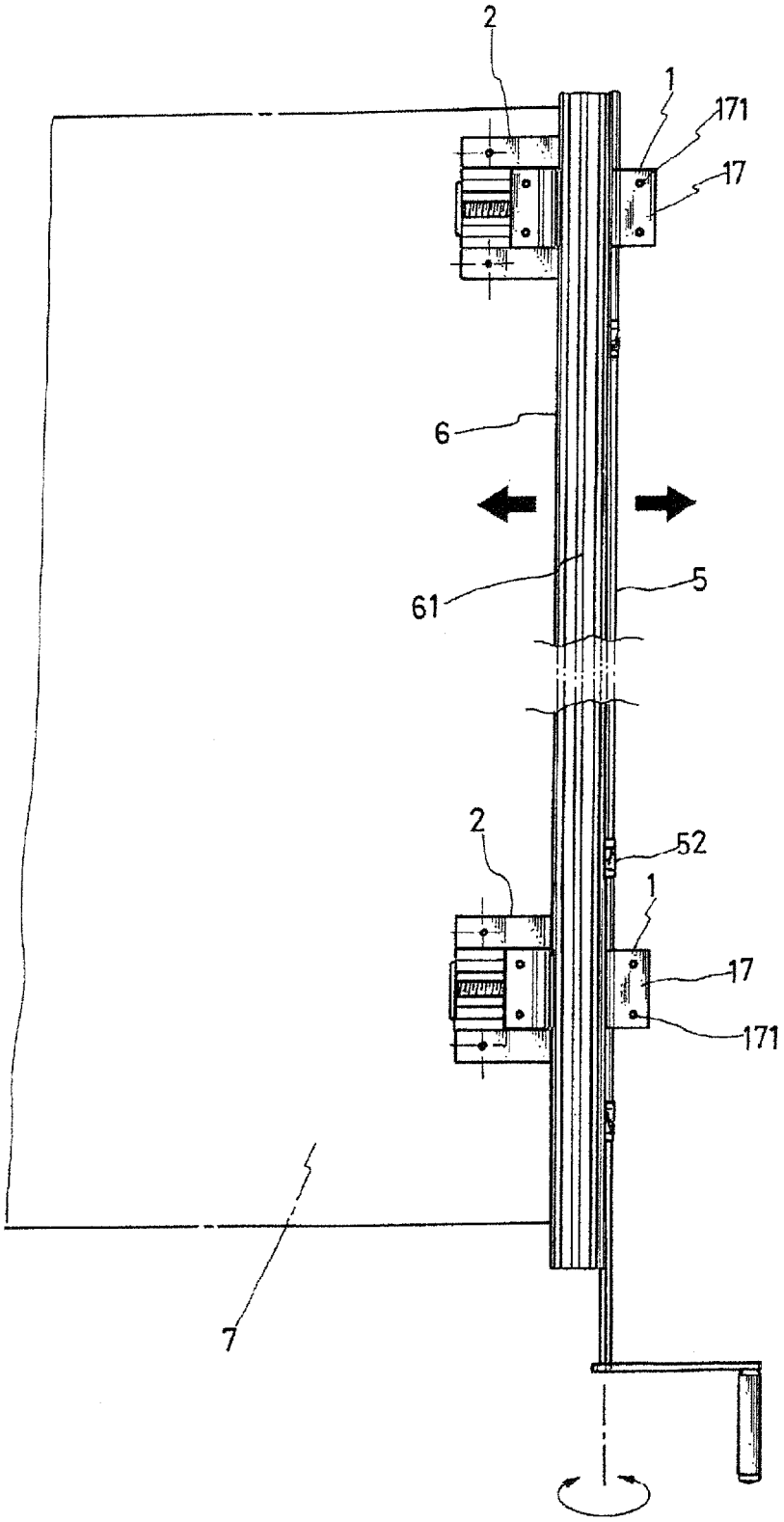
FIG. 1 is a schematic view showing an example of application of the present invention.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring first to FIGS. 1, 2, 3, 4, and 7, the present invention discloses an adjustable large-sized advertisement curtain wind-resistant module, which is mounted to support, in a movable manner, a frame 6 of an advertisement curtain 7 and comprises: a base 1, a slidable board 2, a coupler 3, a transmission device 4, and a transmission rod 5.

The base 1 has two sides forming first slide rails 12 opposing each other. Arranged between the two first slide rails 12, which are arranged symmetric, are a recess 11 and a screw rod 13, wherein the screw rod 13 is arranged in the recess 11. The screw rod 13 has an end forming a first connection section 131 and an opposite end forming a second connection section 132. The screw rod 13 receives at least one nut 14 fit thereto and mating therewith so that the nut 14 is movable along the screw rod 13 in a linear manner. The base 1 is provided with a first stop plate 15 and a second stop plate 16 that respectively correspond to and are fixed to two ends of the recess 11. The first stop plate 15 comprises a first shaft hole 151 formed therein and the second stop plate 16 comprises a second shaft hole 161 formed therein. The first connection section 131 of the screw rod 13 is received in the first shaft hole 151 of the first stop plate 15 and the second connection section 132 of the screw rod 13 is received in the second shaft hole 161 of the second stop plate 16, whereby the screw rod 13 functions a rotation means with the first shaft hole 151 and the second shaft hole 161 collectively defining as a rotation axis so that when the screw rod 13 rotates, the nut 14 is caused to take linear movement.

A side plate 17 extends from an outer surface of each of the two sides of the base 1 and the side plate 17 comprises at least two mounting holes 171 formed therein to receive fasteners extending through the mounting holes 171 of the side plate 17 to fix the base 1 to a fixed object (such as a wall or a steel frame). The first stop plate 15 and the second stop plate 16 can be attached to the base 1 by bonding, welding, or screwing.

Figure 7:
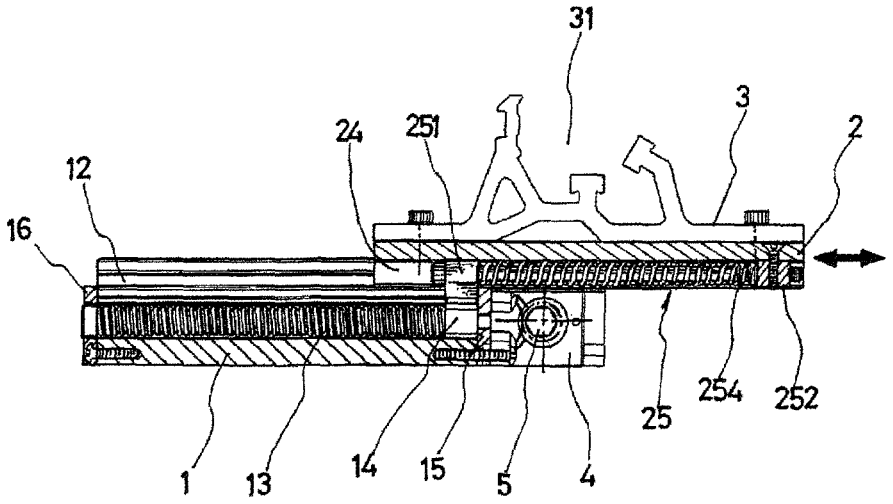
FIG. 7 is a cross-sectional view of the present invention.

The slidable board 2 is coupled to the base 1 and comprises a first surface 21 and a second surface 22. The first surface 21 has two opposite side edges on which second slide rails 23 are respectively formed in a symmetric manner. The second slide rails 23 are respectively engageable with the first slide rails 12 of the base 1 in a relatively slidable manner so that the slidable board 2 is linearly movable on the base 1. The slidable board 2 comprises a third slide rail 24 formed on the first surface 21 between the two second slide rails 23. The third slide rail 24 receives therein a cushioning device 25. The cushioning device 25 comprises: a slide block 251, a positioning block 252, at least one bar 253 (two being shown in the drawings), and at least one elastic element 254 (two being shown in the drawings). The slide block 251 is movably mounted in the third slide rail 24 in order to take linear movement in and along the third slide rail 24. The slide block 251 is coupled to the nut 14 of the base 1, namely the cushioning device 25 being coupled to the nut 14 of the base 1. The positioning block 252 is fixedly mounted to the first surface 21 of the slidable board 2 and is opposite to the slide block 251. The bars 253 are arranged to penetrate through and fix to the slide block 251 and the positioning block 252. The bars 253 respectively receive the elastic elements 254 to fit thereof in an encompassing manner. With the slide block 251 being coupled to the nut 14, the slidable board 2 is supported by the slide block 251 in a slidable manner to achieve elasticity-based position-returning in a direction toward the slide block 251 (as shown in FIG. 7) when acted upon by an external force in an opposite direction whereby the slidable board 2 is provided with an elastic and position-returning function by means of the cushioning device 25.

The coupler 3 is mounted to the second surface 22 of the slidable board 2. The coupler 3 comprises at least one coupling section 31.

The transmission device 4 is mounted to the base 1 at a location adjacent to the first stop plate 15 and comprises: a seat 41, a transmission gear train 42, and a toothed wheel 43. The seat 41 comprises an accommodation space 40 formed therein. The seat 41 comprises two opposite first through holes 411 and a second through hole 412. The two first through holes 411 are arranged along an axis in a direction different from a direction of an axis on which the second through hole 412 is located. The second through hole 412 corresponds to the first connection section 131 of the screw rod 13 and thus corresponds to the first shaft hole 151 of the first stop plate 15. The transmission gear train 42 is mounted in the interior of the seat 41 and is arranged in an axis that is coincident with the axis of the first through holes 411 of the seat 41. The toothed wheel 43 is arranged in the seat 41 and mates the transmission gear train 42. The toothed wheel 43 is set on an axis coincident with the axis of the second through hole 412 of the seat 41 and is set at the location of the second through hole 412. The toothed wheel 43 is coupled to the first connection section 131 of the screw rod 13. Further, the transmission device 4 comprises a cover plate 44. The cover plate 44 is set to cover the seat 41.

The transmission rod 5 is set to extend through the seat 41 of the transmission device 4 and the transmission rod 5 is received through the first through holes 411 of the seat 41 and is coupled to the transmission gear train 42.

The transmission rod 5 drives the transmission gear train 42 of the transmission device 4 to rotate and the transmission gear train 42 of the transmission device 4 drives the toothed wheel 43, so that the toothed wheel 43 drives the screw rod 13 to rotate. When the screw rod 13 rotates, the screw rod 13 drives the nut 14 to undergo linear displacement so that the nut 14 drives the slide block 251 to move. Eventually, the slide block 251 causes the slidable board 2 to move linearly on the base 1.

Figure 5:
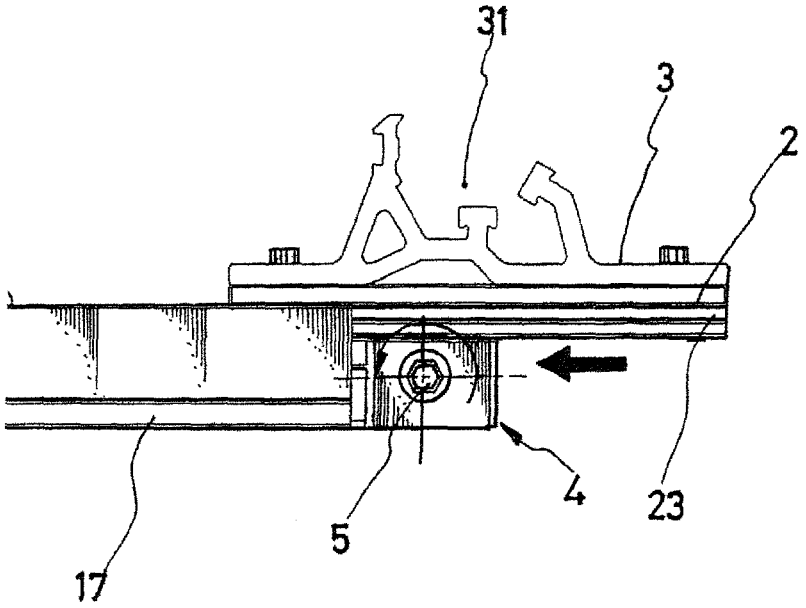
FIG. 5 is a schematic view illustrating a first operation of the present invention.
Figure 6:
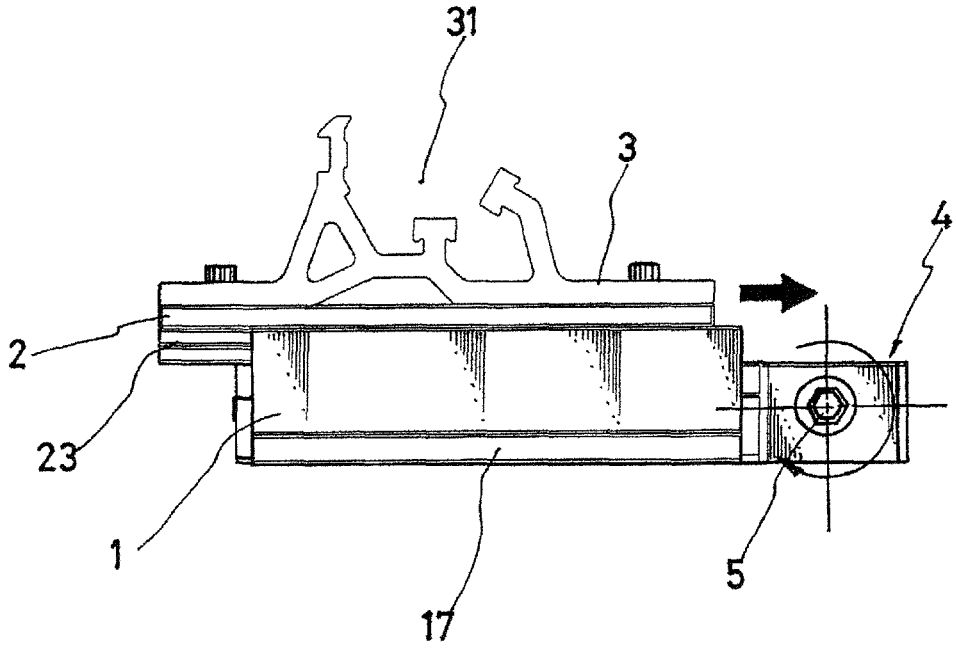
FIG. 6 is a schematic view illustrating a second operation of the present invention.

Also referring to FIGS. 5 and 6, illustration will be given to an example operation of the present invention. When the transmission rod 5 is rotated counterclockwise, the transmission rod 5 drives the transmission device 4 so that the transmission device 4 drives the screw rod 13 to rotate; and the screw rod 13 then drives the slidable board 2 to linearly move on the base 1 in a leftward direction. When the transmission rod 5 is rotated clockwise, the transmission rod 5 drives the transmission device 4 so that the transmission device 4 drives the screw rod 13 to rotate; and the screw rod 13 then drives the slidable board 2 to linearly move on the base 1 in a rightward direction.

As such, when the size of an advertisement curtain 7 does not match the distance between two frames 6, an operator may stand on the ground and rotate the transmission rod 5 to have the slidable board 2 move leftwards or rightward for adjustment. The slidable board 2 may then move the frame 6 carried thereby in unison therewith to achieve an adjustment of the distance between the two frames 6 and thus stretching and flattening the advertisement curtain 7 to show the best condition thereof.

Further, the slidable board 2 is provided with the cushioning device 25 so that the slidable board 2 is provided with an effect of elasticity-based position returning by means of the cushioning device 25 (as shown in FIG. 7), whereby the distance between the two frames 6 is allowed to vary, in a limited manner, with elastic expandability/retractability. When winds strike the advertisement curtain 7, either from the front side or from the back side, and the advertisement curtain 7 bears forces induced by wind drags (wind pressures), the elasticity-based position returning effect of the slidable board 2 provides a wind resisting mechanism for the frame 6 to achieve a cushioning effect against wind drags and to prevent tearing of the advertisement curtain 7 and tipping of the frame 6 caused by excessive wind drags acting on the advertisement curtain 7.

Figure 2:
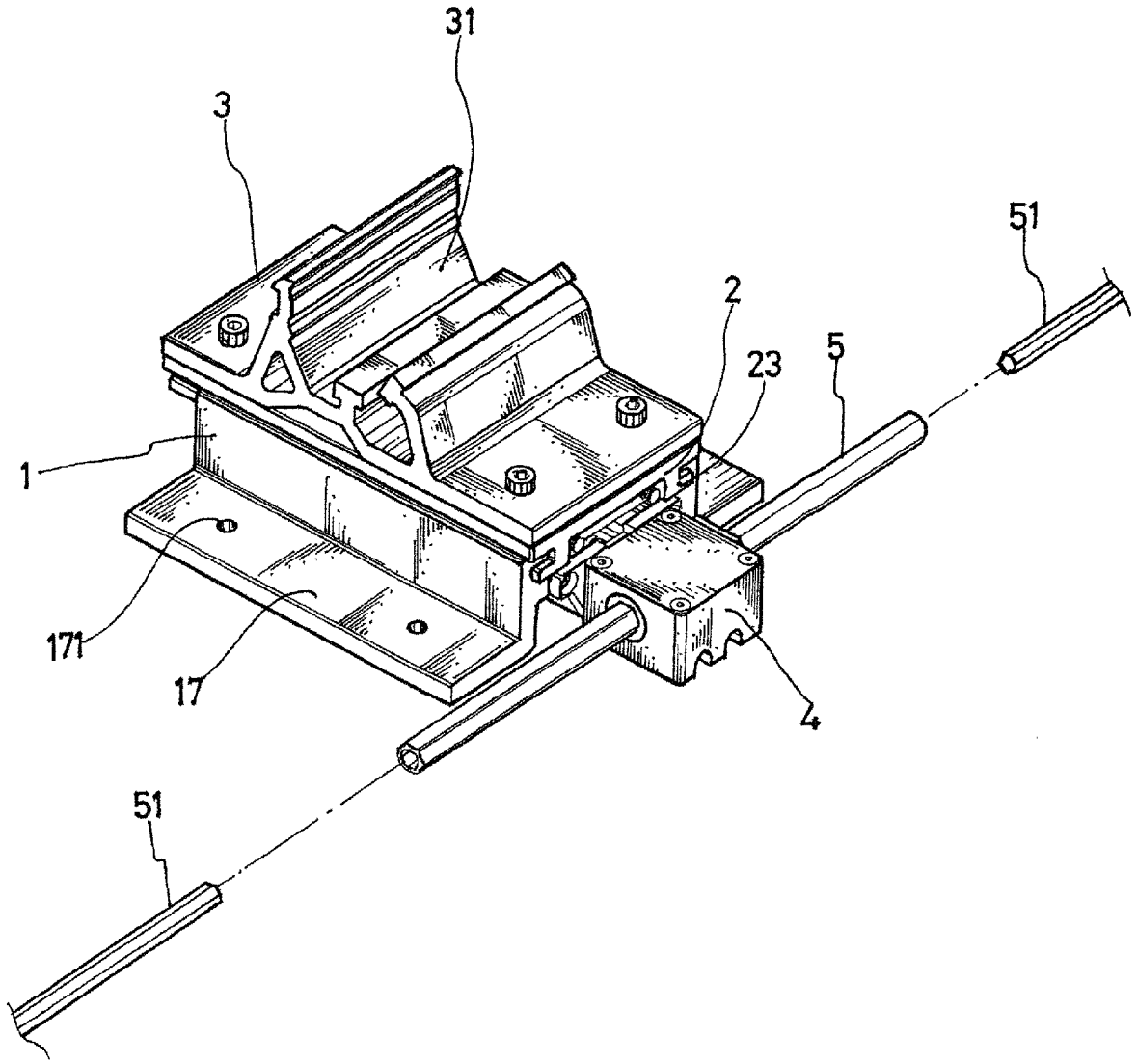
FIG. 2 is a perspective view of the present invention.
Figure 3:
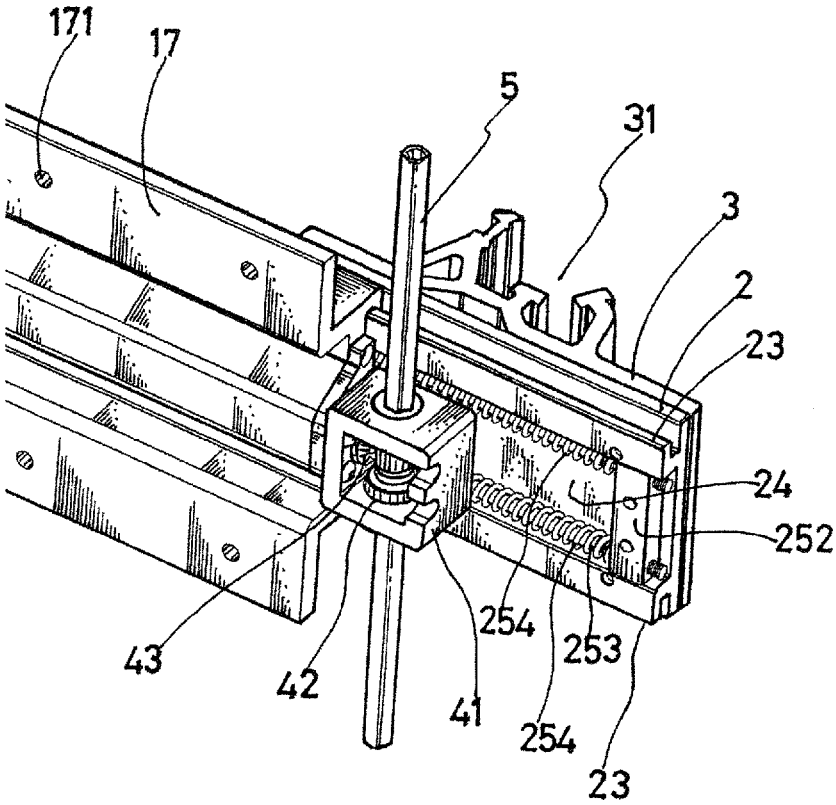
FIG. 3 is another perspective view of the present invention.
Figure 4:
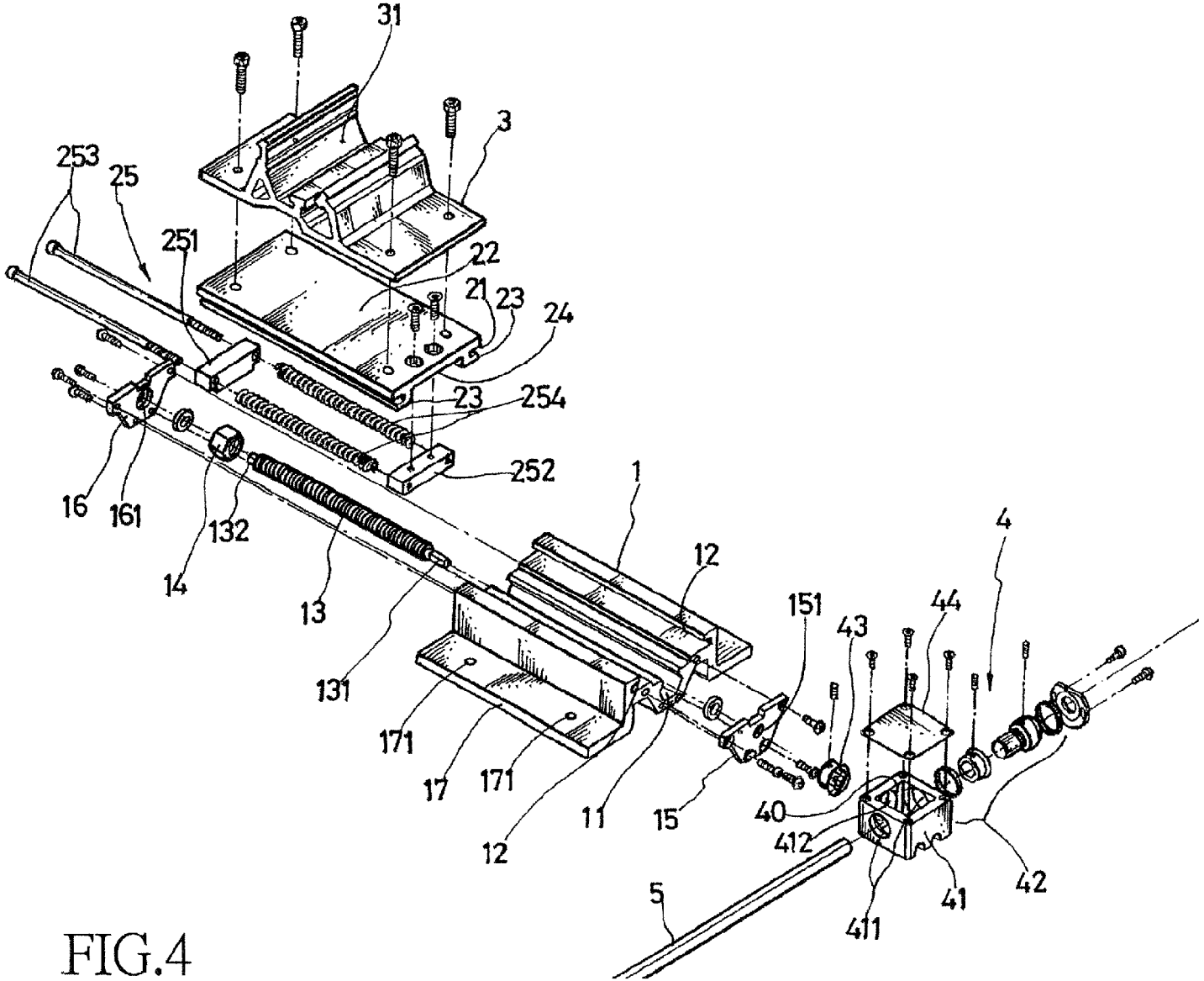
FIG. 4 is an exploded view of the present invention.
Figure 8:
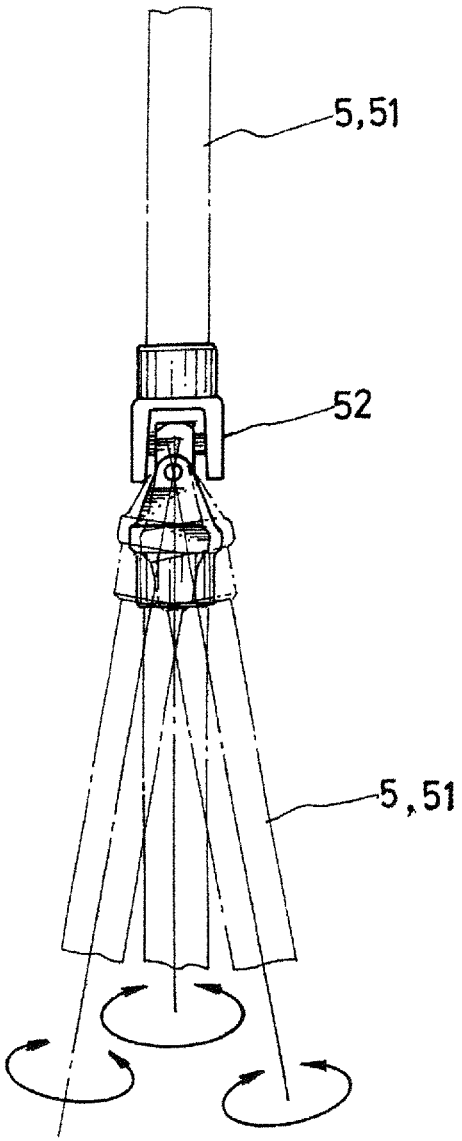
FIG. 8 is a schematic view showing a transmission rod of the present invention.

As shown in FIG. 2, the transmission rod 5 is a unitary bar, but can also comprises a multiple member jointing arrangement, which comprises a tubular member to which a plurality secondary transmission rods 51 is fit to achieve a rotation-transmitting connection between the transmission rod 5 and the secondary transmission rod 51 so as to realize an advantage of length adjustment. Further, as shown in FIGS. 1 and 8, the transmission rod 5 and/or the secondary transmission rods 51 can be jointed to each other through a universal joint 52 so that the secondary transmission rods 51 can be jointed through the universal joints 52 to thereby provide a rotation-transmitting but bendable feature and an individual secondary transmission rod 51 or a combination of secondary transmission rods 51 can be jointed through a universal joint 52 to the transmission rod 5 for operating in a condition where the fixture (such as a wall or a steel frame) to which the advertisement curtain is mounted is in an irregular configuration.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An adjustable large-sized advertisement curtain wind-resistant module, which is adapted to support a frame of an advertisement curtain, comprising:

a base, which has two sides forming first slide rails opposing each other and comprises a screw rod, the screw rod having an end forming a first connection section and an opposite end forming a second connection section, the screw rod receiving at least one nut fit thereto and mating therewith so that the nut is linearly movable along the screw rod;

a slidable board, which is coupled to the base and has a first surface and a second surface, the slidable board comprising opposite second slide rails respectively formed on opposite side edges of the first surface, the second slide rails being respectively engageable with the first slide rails of the base in a relatively slidable manner, the slidable board comprising a third slide rail formed on the first surface between the second slide rails and a cushioning device received in the third slide rail, the cushioning device being coupled to the nut of the base;

a coupler, which is mounted to the second surface of the slidable board, the coupler comprising at least one coupling section;

a transmission device, which is mounted to the base and comprises:

a seat, which comprises two opposite first through hole and a second through hole, the two first through holes being arranged along an axis that is in a direction different from an axis on which the second through hole is located, the second through hole corresponding to the first connection section of the screw rod, a transmission gear train, which is mounted in the seat and arranged in an axis coincident with the axis of the two first through holes, and a toothed wheel, which is arranged in the seat and mates the transmission gear train, the toothed wheel being set on an axis coincident with the axis of the second through hole and set at the location of the second through hole, the toothed wheel being coupled to the first connection section of the screw rod; and a transmission rod assembly, which comprises a rod received in the two first through holes of the seat and is coupled to the transmission gear train.

2. The adjustable large-sized advertisement curtain wind-resistant module according to claim 1, wherein the base comprises a recess formed between the first slide rails, the screw rod being received in the recess, the base comprising a first stop plate and a second stop plate mounted to two ends of the recess, the first stop plate comprising a first shaft hole formed therein, the second stop plate comprising a second shaft hole formed therein, the first connection section of the screw rod being received in the first shaft hole of the first stop plate, the second connection section of the screw rod being received in the second shaft hole of the second stop plate.

3. The adjustable large-sized advertisement curtain wind-resistant module according to claim 1, wherein the base comprises a side plate extending from each of the two sides thereof, the side plate comprising at least two mounting holes.

4. The adjustable large-sized advertisement curtain wind-resistant module according to claim 1, wherein the cushioning device comprises a slide block, a positioning block, at least one bar, and at least one elastic element, the slide block being movably received in the third slide rail and being linearly movable along the third slide rail, the slide block being coupled to the nut of the base, the positioning block being fixed to the first surface of the slidable board and opposite to the slide block, the bar being arranged to penetrate through and fix to the slide block and the positioning block, the elastic element being fit over and encompassing the bar.

5. The adjustable large-sized advertisement curtain wind-resistant module according to claim 1, wherein the seat of the transmission device comprises an accommodation space formed therein, the transmission gear train being arranged in the accommodation space.

6. The adjustable large-sized advertisement curtain wind-resistant module according to claim 1, wherein the transmission rod assembly comprises a multiple member jointing arrangement comprising a plurality of secondary transmission rods jointed to each other through universal joints.

7. The adjustable large-sized advertisement curtain wind-resistant module according to claim 6, wherein the rod of the transmission rod assembly is jointed through universal joints to the secondary transmission rods.

* * * * *